US006276544B1

(12) United States Patent
Battegazzore

(10) Patent No.: US 6,276,544 B1
(45) Date of Patent: Aug. 21, 2001

(54) SECURITY CLOSURE FOR A BOTTLE

(75) Inventor: Piero Battegazzore, Alessandria (IT)

(73) Assignee: Guala Closures S.p.A., Alessandria (IT)

( * ) Notice: Subject to any disclaimer, the term of this patent is extended or adjusted under 35 U.S.C. 154(b) by 0 days.

(21) Appl. No.: 09/445,013

(22) PCT Filed: May 29, 1998

(86) PCT No.: PCT/EP98/03240

§ 371 Date: Feb. 15, 2000

§ 102(e) Date: Feb. 15, 2000

(87) PCT Pub. No.: WO98/55370

PCT Pub. Date: Dec. 10, 1998

(30) Foreign Application Priority Data

Jun. 9, 1997 (IT) ..... MI97A1310

(51) Int. Cl.[7] ..... B65D 41/34

(52) U.S. Cl. ..... 215/252; 215/44; 215/45; 215/258; 215/321; 215/334

(58) Field of Search ..... 215/44, 43, 34, 215/317, 334, 330, 331, 901, 252, 258; 220/293

(56) References Cited

U.S. PATENT DOCUMENTS

| | | | | |
|---|---|---|---|---|
| 3,850,328 | * | 11/1974 | Guala | 215/252 |
| 4,280,632 | * | 7/1981 | Yuhara | 215/334 X |
| 4,458,817 | * | 7/1984 | Guala | 215/252 X |
| 4,550,845 | * | 11/1985 | Guala | 215/252 |
| 4,597,501 | * | 7/1986 | Gueret | 215/331 X |
| 5,131,549 | * | 7/1992 | Battegazzore | 215/252 |
| 5,135,124 | * | 8/1992 | Wobser | 220/293 X |
| 5,251,769 | * | 10/1993 | Battegazzore | 215/252 |
| 5,593,055 | * | 1/1997 | Repp et al. | 215/256 |
| 5,628,417 | * | 5/1997 | Van Halteren | 215/44 |
| 5,740,932 | * | 4/1998 | Battegazzore | 215/334 X |
| 5,927,531 | * | 7/1999 | Kuzma et al. | 215/43 X |

FOREIGN PATENT DOCUMENTS

| | | |
|---|---|---|
| 1517037 | 6/1968 | (FR) . |
| 2200619 | 8/1988 | (GB) . |

* cited by examiner

*Primary Examiner*—Allan N. Shoap
*Assistant Examiner*—Robin A. Hylton
(74) *Attorney, Agent, or Firm*—Sofer & Haroun, LLP

(57) ABSTRACT

A security closure (1) for a glass bottle (2), which can be fitted on the bottle (2) quickly and can be manipulated conveniently, comprises a cap (3) having internal threading (16) with a predetermined large number of starts mating with external threading (17) on the bottle (2), the cap being connected, by means of a line of weakening (10), to a sleeve (11) restrained axially and angularly on the bottle (2), the closure further comprising lead-in means (20) in the sleeve (11) mating with matching lead-in means (21) on the bottle (2) in order to orient the cap (3) and the sleeve (11) angularly relative to the bottle (2) when the cap (3) and the sleeve (11) are fitted axially on the bottle (2).

9 Claims, 3 Drawing Sheets

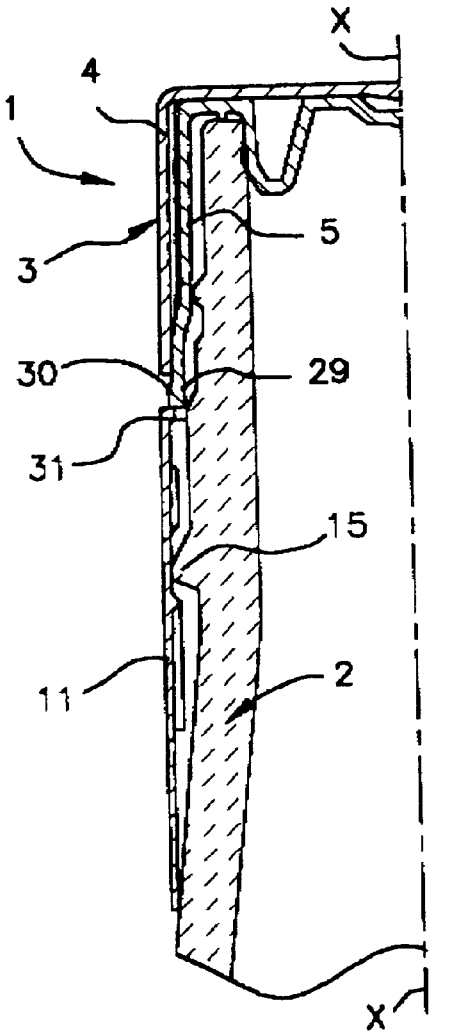
FIG. 6
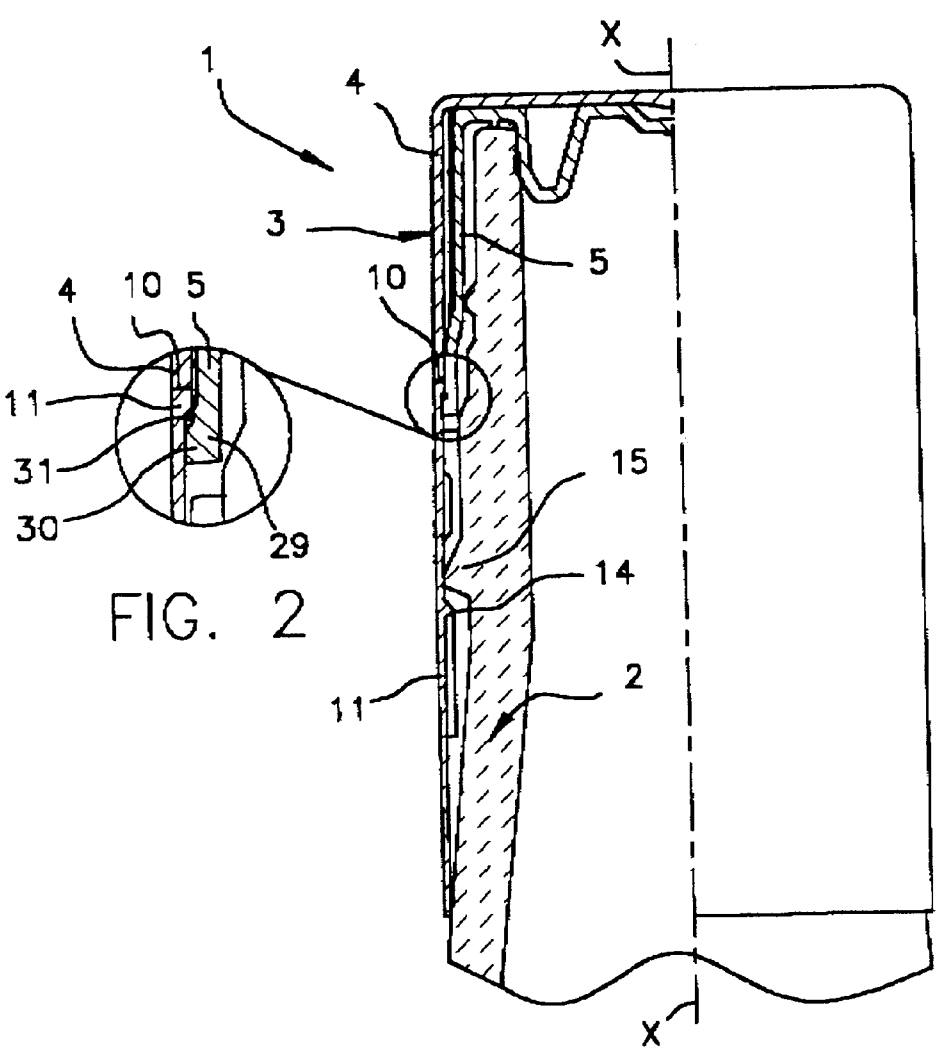
FIG. 1
FIG. 2

SECURITY CLOSURE FOR A BOTTLE

DESCRIPTION

This application claims priority to Italian Patent Application Number 97A001310 filed on Jun. 3, 1997 and is a National Stage PCT Application from Serial Number PCT/EP98/03240.

The present invention relates to a security closure f or a bottle comprising a cap having internal threading mating with external threading on the bottle, the cap being connected, by means of a line of weakening, to a sleeve restrained angularly and axially on the bottle.

As is known, there is a need to provide evidence that a bottle has been opened so that someone does not purchase a bottle which has previously been opened by an unauthorized person.

Closures are known, in which the cap and the sleeve are formed integrally from aluminium sheet and are fitted on the bottle together and made to adhere to the bottle by rolling, causing the cap to marry with the threading of the bottle, which is often coarse threading, particularly if the bottle is molded from glass and, at the same time, restraining the sleeve on the bottle.

The fitting of these closures requires complex tooling. Moreover, they do not fully satisfy the user since, starting from the first time they are unscrewed and on every subsequent occasion when they are screwed up and unscrewed, the cap jams and sticks and in any case is manipulated with far front the desirable smoothness.

Closures in which the cap and the sleeve are formed integrally of plastics material have also been proposed. In these closures, the cap is manipulated with convenient smoothness during unscrewing and screwing-up. The fitting of these closures, however, is labourious and requires complex tooling which has to apply the single element of plastics material to the bottle by axial fitting accompanied by rotation with predetermined synchronized coordination so that the threading of the cap can be screwed onto the threading of the bottle.

The problem upon which the present invention is based is that of providing a security closure of the type specified which has structural and functional characteristics such as to overcome the problems mentioned above with reference to the prior art.

This problem is solved by a closure of the type specified which is characterized in that the internal threading has a predetermined large number of starts, and in that lead-in means are formed in the sleeve and are mated with matching lead-in means on the bottle in order to orient the cap and the sleeve angularly relative to the bottle when the cap and the sleeve are fitted axially on tie bottle.

Figure 3:
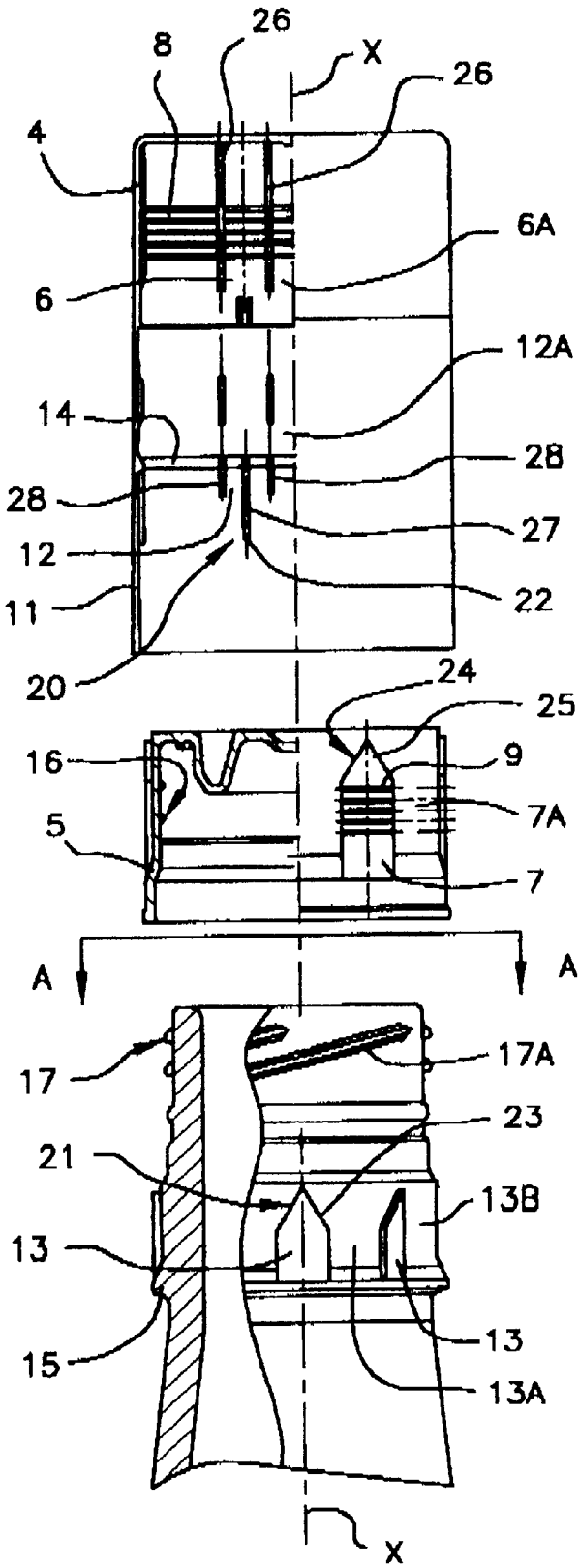
Figure 4:
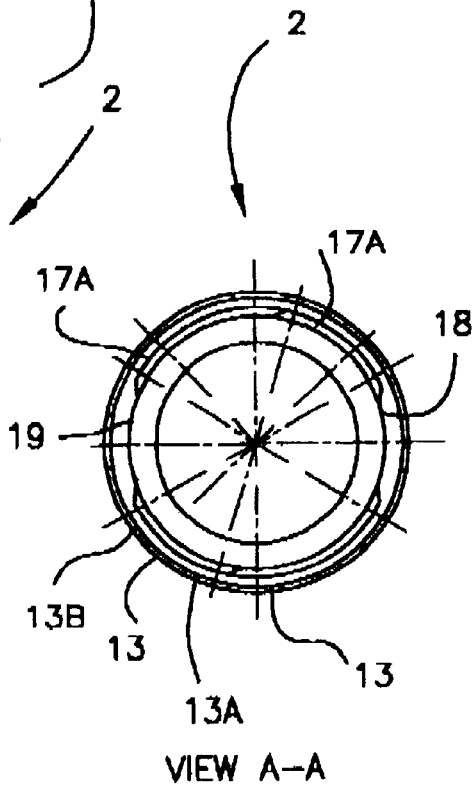
Figure 5:
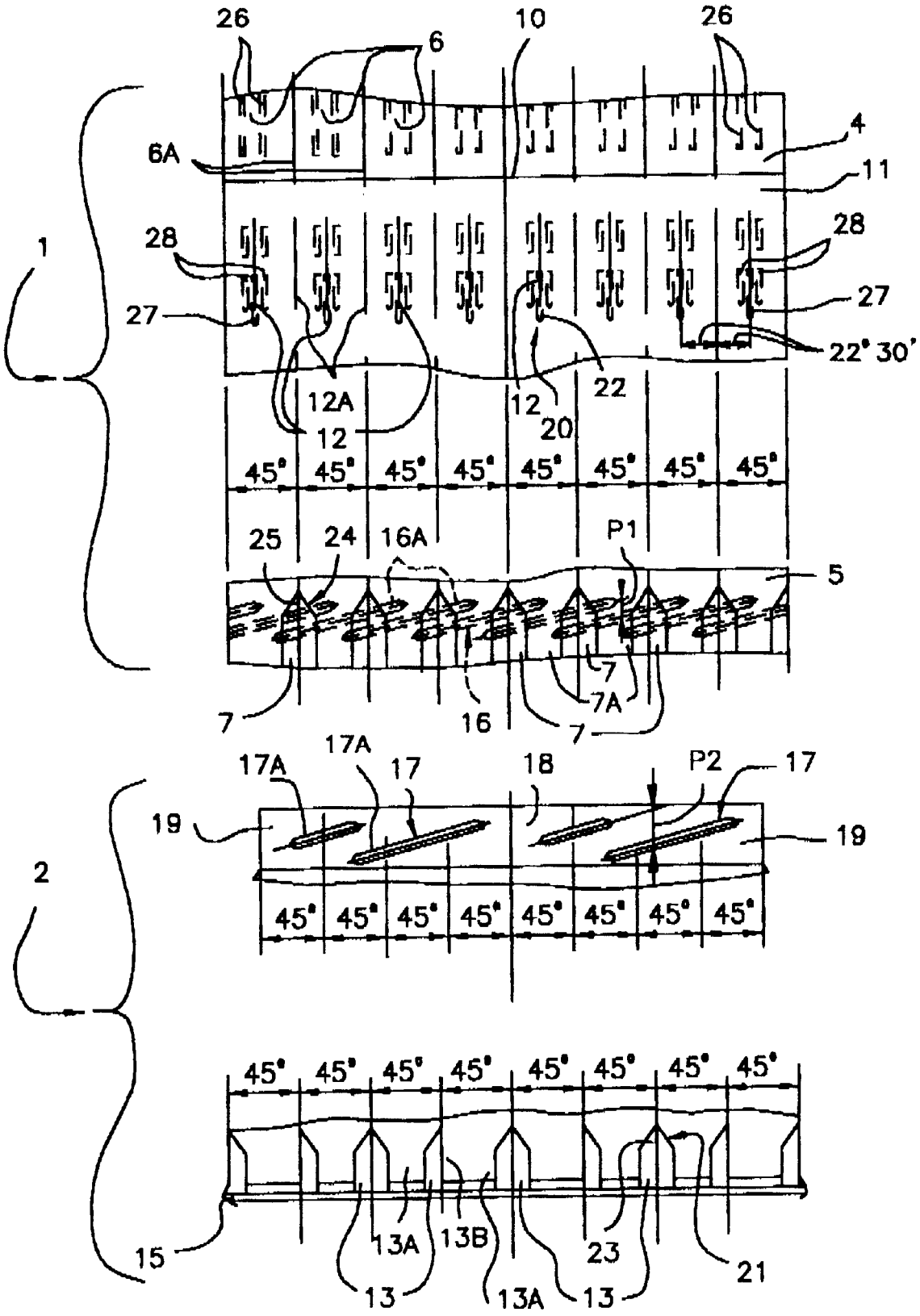

Further characteristics and the advantages of the security closure according to the present invention will become clear from the following description of an embodiment thereof, given by way of non-limiting example, with reference to the appended drawings, in which:

FIG. 1 is a partially-sectioned elevational view of a security closure according to the invention, FIG. 2 is a sectioned view showing a detail of the security closure of FIG. 1, on an enlarged scale, FIG. 3 is a partially-sectioned, exploded elevational view of the security closure of FIG. 1, FIG. 4 is a sectioned view, taken on the arrow IV, of a detail of a bottle for which the security closure of FIG. 1 is intended, FIG. 5 is a plan view of the inner circular surface of the cap and of mating outer surface of the bottle.

FIG. 6 is a partially-sectioned elevational view of the security closure of FIG. 1 at another stage of its operation.

With reference to the appended drawings, these show a combination of a security closure, generally indicated 1, and a bottle 2 for which the security closure 1 is intended, the bottle having a vertical X axis, and preferably being made of molded glass.

The closure 1 comprises a cap 3 disposed atop bottle 2 at the upper end of its vertical X axis, comprising an outer cap 4 and an inner cap 5 restrained axially in the outer cap 4.

In particular, in order to restrain the inner cap 5 axially in the outer cap 4, axial teeth 6 and axial teeth 7, distributed circumferentially at regular intervals, are provided in the outer cap and in the inner cap, respectively. The teeth 6 and the teeth 7 define between each tooth and the next, respective spaces 6*a* and 7*a* having a width substantially equal to the width of a tooth so that the teeth 6 and 7 are arranged in mutual comb-like engagement, forming a splined coupling for preventing rotation. Mutually snap-engaged circumferential recesses 8 in the outer cap and circumferential projections 9 in the inner cap are provided for restraining the inner cap 5 axially in the outer cap 4.

In the closure 1, the outer cap 4 of the cap 3 is connected by means of a line of weakening 10 to a sleeve 11 disposed circumferentially about the vertical X axis of bottle 2, which is restrained angularly and axially on the bottle 2.

In particular, axial teeth 12 and axial teeth 13, distributed circumferentially at regular intervals in the sleeve 11 and on the bottle 2, respectively, are provided for restraining the sleeve 11 angularly on the bottle 2. The teeth 12 and the teeth 13 define between each tooth and the next respective spaces 12*a* 13*a* having a width substantially equal to the width of a tooth so that the teeth 12 and 13 are arranged in mutual comb-like engagement, forming a splined coupling for preventing rotation. A circumferential projection 14 inside the sleeve and a collar 15 on the bottle, which are mutually snap-engaged, are provided for restraining the sleeve axially on the bottle 2.

It should be noted that the axial teeth 12 of the sleeve are aligned axially with the axial teeth 6 of the outer cap.

The outer cap 4 and the sleeve 11 are formed integrally by injection molding of a suitable plastics material, for example, polypropylene.

The inner cap 5 is made by injection molding of a suitable plastics material, for example, polyethylene.

The combination according to the invention is provided with a threaded coupling defined by internal threading 16 in the inner cap 5 of the cap 3 and external threading 17 on the bottle 2.

The internal threading 16 comprises a predetermined large number N of starts. In the embodiment shown, it comprises eight starts and thus has eight threads 16*a* between which an apparent pitch P1, of 2.5 mm in the embodiment shown, is formed.

The external threading 17 on the bottle 2 advantageously has half as many starts as the threading 16 and thus comprises four starts in the embodiment shown, and hence four threads 17*a* between which an apparent pitch P2 of twice the apparent pitch P1, more precisely, 5 mm in the embodiment shown, is formed.

The external threading 17 on the bottle 2 preferably has a gap due to shortening of two threads 17*a* in two diametrally-opposed regions 18 and 19 of the bottle, these regions being disposed on the joining line of the mold from which the bottle is produced to allow the mold to be opened. A few teeth 13 of the bottle also have respective missing portions 13*b* to allow the mold to be opened.

In order to fit the security closure 1 axially on the bottle 2 lead-in means 20 in the sleeve 11 and matching lead-in means 21 on the bottle 2 are provided for orienting the cap and the sleeve angularly relative to the bottle.

The lead-in means 20 are constituted by the axial teeth 12 and by respective tips 22 with which the teeth are provided at their ends. The matching lead-in means 21 are constituted by the teeth 13 and by respective tips 23 with which the teeth are provided at their ends.

It should be noted that, in order to fit the inner cap 5 axially in the outer cap 4, matching lead-in means 24 are provided on the inner cap 5 and mate with the lead-in means 20 formed in the sleeve 11 in order to orient the inner cap angularly relative to the outer cap.

The matching lead-in means 24 are constituted by the teeth 7 and by respective tips 25 with which the teeth are provided in the region of their ends.

Owing to the predetermined large number N of starts of the internal threading, it is important to note that the number of axial teeth 6, 7, 12 and 13 is large and equal to N, that is eight, in the embodiment shown.

It should be noted that, in order to reduce the non-uniformity in the thickness of the outer cap and of the sleeve as a whole, the teeth 6 are actually constituted by two axial ribs 26, and the teeth 12 are actually constituted by a longer, central axial rib 27, the end of which defines the tip 22, and by two set-back, that is shorter, lateral axial ribs 28, aligned with the axial ribs 26.

The inner cap comprises an annular end portion 29 which projects from the outer cap 4, beyond the line of weakening 10, and has a collar 30 in snap-releasable engagement in a recess 31 in the sleeve.

When the inner cap is fitted in the outer cap, it is disposed in a predetermined angular orientation relative to the sleeve by means of the lead-in means 20 and the matching lead-in means 24. When the cap and the sleeve together are fitted axially on the bottle, they are disposed in a predetermined angular orientation relative to the bottle by means of the lead-in means 20 and the matching lead-in means 21.

These angular orientations are selected in a manner such that, when the security closure is fitted axially on the bottle, the threads 16*a* of the internal threading 16 of the cap are fitted securely between the threads 17*a* of the external threading 17 of the bottle so as to prevent thread-against-thread situations and consequent bulging of the closure, thus ensuring a perfectly cylindrical outer surface of the closure.

Clearly, the large number of starts of the threaded coupling enables the necessary angular orientation to be achieved by an angular movement of small magnitude caused by the cooperation of the lead-in means and the matching lead-in means. In the embodiment shown, this angular movement amounts at most to 22°30' to one side and 22°30' to the other side.

The same applies to the angular orientation which has to be achieved between the inner cap and the outer cap when the inner cap is fitted axially in the outer cap.

In operation, the first time the cap is unscrewed, the line of weakening 10 is torn so that it remains evident that the bottle has been opened.

During the first unscrewing of the cap, the collar 30 of the annular portion 29 of the inner cap 5 snaps out of the recess 31 in the sleeve 11. When the cap is subsequently screwed back onto the bottle, the annular portion 29 interferes with the upper end of the sleeve 11 and brings about a downward axial movement of the sleeve, providing further evidence that the bottle has been opened.

The main advantage of the closure according to the present invention lies in the fact that it has achieved unusually quick application of the cap, which is simply fitted axially and, at the same time, also convenient manipulation of the cap the first time it is unscrewed and on every subsequent occasion when it is screwed-up and unscrewed.

Naturally, in order to satisfy contingent and specific requirements, an expert in the art may apply to the above-described closure many modifications and variations all of which, however, are included within the scope of protection of the invention as defined by the following claims.

What is claimed is:

1. A security closure in combination with a bottle, said security closure and bottle comprising:

a cap having internal threading with a predetermined large number of starts;

a bottle having external threading mating with said internal threading of said cap and further having bottle mounted cap orientation lead-in means;

a sleeve comprising sleeve mounted cap orientation lead-in means configured to match said bottle mounted cap orientation lead-in means, said sleeve mounted cap orientation lead-in means comprised of teeth distributed circumferentially at regular intervals in said sleeve, said teeth each being formed from a longer central rib forming a tip and two set-back lateral ribs, each of said teeth having a width, said width also defining the space between each of said teeth and an adjacent tooth, with said number of teeth being equal to said number of starts of the internal threading;

wherein said cap is connected to said sleeve by way of a line of weakening and wherein said sleeve is angularly and axially restrained on said bottle such that, when said sleeve mounted cap orientation lead-in means and said bottle mounted cap orientation lead-in means are mated, said cap and said sleeve are oriented angularly relative to said bottle and said cap and said sleeve are fitted axially on said bottle.

2. The security closure and bottle combination according to claim 1, wherein said external threading has half as many said starts as said internal threading and twice the apparent pitch of said internal threading.

3. The security closure and bottle combination according to claim 2, wherein said internal threading has eight said starts disposed thereon and said external threading has four said starts disposed thereon.

4. The security closure and bottle combination according to claim 3, wherein said external threading has gaps in two diametrically-opposed regions of said bottle.

5.The security closure and bottle combination according to claim 1, wherein said matching sleeve mounted cap orientation lead-in means and said bottle mounted cap orientation lead-in means are comprised of teeth of a width substantially equal to the width of the spaces between each tooth and the next tooth of said sleeve mounted cap orientation lead in-means, said teeth having tips and being distributed circumferentially at regular intervals on said bottle.

6.The security closure and bottle combination according to claim 5, wherein in at least one of said teeth of said matching cap orientation lead-in means, a missing portion is disposed for permitting removal from a mold.

7. The security closure and bottle combination according to claim 1, wherein said cap comprises an outer cap fixed to said sleeve by means of said line of weakening and an inner cap fitted in said outer cap and having said internal threading;

said inner cap being restrained angularly and axially within said outer cap and having matching said cap orientation lead-in means mating with the cap orientation lead-in means of said sleeve configured to orient said inner cap relative to said outer cap when said inner cap is fitted axially in said outer cap.

8. The security closure and bottle combination according to claim 7, wherein said matching sleeve mounted cap orientation lead-in means of said inner cap comprise teeth of a width substantially equal to the width of the spaces between each of said teeth and the next tooth of said cap orientation lead-in means of said sleeve, said teeth being distributed circumferentially at regular intervals and having tips.

9. The security closure and bottle combination according to claim 8, wherein said inner cap comprises an annular end portion projecting from said outer cap, beyond said line of weakening, and having a collar in snap-releasable engagement in a recess in said sleeve.

* * * * *